US005174209A

United States Patent [19]

Rodi et al.

[11] Patent Number: 5,174,209

[45] Date of Patent: Dec. 29, 1992

[54] METHOD OF WASHING A PRINTING PRESS WITH A WASHING APPARATUS

[75] Inventors: Anton Rodi, Leiman; Hermann Beisel, Walldorf; Bernd Müller, Nussloch, all of Fed. Rep. of Germany

[73] Assignee: Heidelberger Druckmaschinen AG, Heidelberg, Fed. Rep. of Germany

[21] Appl. No.: 692,380

[22] Filed: Apr. 26, 1991

[30] Foreign Application Priority Data

Apr. 27, 1990 [DE] Fed. Rep. of Germany ..... 4013465

[51] Int. Cl.[5] ..... B41F 35/00

[52] U.S. Cl. ..... 101/424; 101/425

[58] Field of Search ..... 101/423, 424, 425, 216

[56] References Cited

U.S. PATENT DOCUMENTS

| | | | |
|---|---|---|---|
| 3,766,853 | 10/1973 | Gallagher et al. | 101/425 |
| 4,311,095 | 1/1982 | Jeschke | 101/425 |
| 4,967,664 | 11/1990 | Iijima | 101/425 |
| 4,986,176 | 1/1991 | Ishii et al. | 101/148 |
| 5,046,416 | 9/1991 | Freyer et al. | 101/425 |

FOREIGN PATENT DOCUMENTS 3606007 10/1986 Fed. Rep. of Germany .

*Primary Examiner*—Edgar S. Burr
*Assistant Examiner*—Ren Yan
*Attorney, Agent, or Firm*—Nils H. Ljungman and Associates

[57] ABSTRACT

A method of washing an offset printing press having a plate cylinder, a rubber blanket cylinder, an impression cylinder, an inking unit a paper thickness compensator and a damping unit. The inking unit and the damping unit include, respectively, inking rollers and damping solution applicator rollers. The offset printing press also includes a washing apparatus. The washing apparatus, when in the wash mode, is placed in engagement with the rubber blanket cylinder of the printing press by control apparatus. Also, in the wash mode, the impression cylinder is engaged with or disengaged from the rubber blanket cylinder by a paper thickness compensator. The usual purpose of the paper thickness compensator is to compensate for the thickness of the stock in running-on mode but is employed herein also to effectuate washing of various rollers and/or cylinders of the printing press.

20 Claims, 9 Drawing Sheets

METHOD OF WASHING A PRINTING PRESS WITH A WASHING APPARATUS

BACKGROUND OF THE INVENTION

1. Field of the Invention

The present invention relates to printing presses and, particularly, offset printing presses. The printing unit of such printing presses includes a plate cylinder, a rubber blanket cylinder, an impression cylinder, an inking unit and a damping unit. The inking unit and damping unit include, respectively, inking rollers and damping solution applicator rollers. Such printing presses, also, include washing apparatus that, when in the wash mode position, is brought into engagement with the rubber blanket cylinder by control apparatus.

2. Background Information

Printing presses in which the present invention may be employed are well known. U.S. patent application Ser. No. 07/482,260, which is now allowed and which will issue as U.S. Pat. No. 5,010,820 on Apr. 30, 1991, discloses one such printing press.

It is known to use a washing apparatus for the cleaning of rollers and/or cylinders of offset printing presses. According to one known design, a washing apparatus is brought into engagement with the blanket cylinder to clean the blanket cylinder. A separate impression cylinder washing apparatus is provided in order to clean the impression cylinder. The plate cylinder is cleaned by the inking rollers. The cleaning of the damping unit is possible through the intermediary of the inking rollers, provided that a connection can be established between the inking unit and the damping unit by means of an intermediate roller.

The known designs have the disadvantage that the various apparatus entail high costs of manufacture and/or operation and also require a large amount of space. Furthermore, a correspondingly large amount of time is required in order to operate the various apparatus.

OBJECTS OF THE INVENTION

One object of the present invention, therefore, is to provide a printing press in which the outlay on equipment for washing is relatively small, and simple operation is ensured.

Another object of the present invention is to provide a printing press in which existing equipment may be employed to activate and deactivate the wash cycle of the printing press, thereby eliminating additional equipment and reducing cost.

SUMMARY OF THE INVENTION

These objects of the present invention are achieved by employing the existing paper thickness compensator of the printing press to move various rollers into and out of engagement with one another. For example, in the wash mode, the impression cylinder is moved into or out of engagement with the rubber blanket cylinder by the paper thickness compensator of the press. The usual purpose of employing a paper thickness compensator in a printing press is to adjust the press rollers and/or cylinders to compensate for the thickness of the paper stock when the printing press is in the running-on mode.

Consequently, it is possible to clean both the rubber blanket cylinder and also the impression cylinder with just one washing apparatus, provided that the rubber blanket cylinder and the impression cylinder are engaged with one another. Since, during the running-on process, only slight contamination of the impression cylinder is to be expected and since paper stock is interposed between the impression cylinder and the rubber blanket cylinder and the stock reduces the amount of contamination that may reach the impression cylinder, usually only the stock-free edges of the impression cylinder accept ink. Therefore, when the rubber blanket of the rubber blanket cylinder is washed, it is not always necessary to simultaneously clean the impression cylinder. In order to exclude such simultaneous cleaning of the impression cylinder, the rubber blanket cylinder is disengaged from the impression cylinder.

Such disengagement can be achieved in surprising manner with an apparatus that is usually provided for an entirely different purpose and in a different operating mode. Such apparatus is the paper thickness compensator of the printing press. The generally intended purpose of the paper thickness compensator is, in the running-on mode, to compensate for the thickness of the stock. In other words, the distance between the rubber blanket cylinder and the other cylinder and/or rollers is adjusted by the paper thickness compensator as a function of the thickness of the stock (e.g. thickness of paper). If, during washing, the distance between the blanket and impression cylinders is reduced to zero by the paper thickness compensator, that is they are touching one another, then the rubber blanket washing apparatus will not only clean the rubber blanket of the rubber blanket cylinder, but will also wash the impression cylinder. Conversely, it is possible to adjust the paper thickness compensator within its range of adjustment to such an extent that the rubber blanket cylinder and the impression cylinder are at a sufficient distance from one another such that, in the washing mode, no washing liquid is transferred to the impression cylinder. Consequently, only the rubber blanket cylinder, and not the impression cylinder, is washed.

Using just one washing apparatus that requires only a small amount of available space and is simple to operate, (that is the paper thickness compensator), it is possible to clean different cylinders of the printing press in a completely novel manner. In this manner, the above and below described washing operations can be performed without any design modifications to known printing presses.

Preferably, the paper thickness compensator includes a remotely controllable drive that may be an electric drive. In such a case, adjustment of the paper thickness compensator can be effected from the control console of the printing press by the manual press of a button, or similar control, or can be performed by a computer controlled printing press control.

In order to allow simultaneous cleaning of the plate and blanket cylinders of the printing press, the control apparatus moves the rubber blanket cylinder and the plate cylinder into engagement with one another, with the result that washing liquid is transferred from the rubber blanket cylinder onto the plate cylinder. Under such circumstances, the impression cylinder is disengaged from the blanket cylinder and simultaneous cleaning of the rubber blanket cylinder and the plate cylinder occurs.

The washing mode, which can be carried out with just one aforementioned washing apparatus, can also be extended to the damping unit, wherein the control apparatus and the paper thickness compensator move the damping solution applicator roller into engagement with the plate cylinder. The washing liquid can then pass from the rubber blanket cylinder, to the plate cylinder, to the damping solution applicator roller and into the damping unit. Ink residues can be washed out very well from those rollers in the above described manner. Also, there may be a removal of gumming residues that remain in the damping unit since the gumming agent is transferred to the printing plate of the plate cylinder by the damping unit.

To prevent washing liquid from penetrating into the damping solution reservoir of the printing press, the control apparatus separates the damping solution supply apparatus from rollers of the damping unit that lead to the plate cylinder. Preferably, the separation point is made between the damping solution applicator roller and a metering roller that cooperates with a fountain roller of the damping unit. The fountain roller is immersed, over part of its circumference, in the damping solution that is in a damping solution box.

In a preferred embodiment of the present invention, it is possible that the control apparatus connects the inking unit and the damping unit to one another through an intermediate roller. This results in the rollers of the inking unit being washed with washing liquid supplied from the damping unit. Therefore, the washing liquid coming from the rubber blanket cylinder washing apparatus is able to pass via the plate cylinder, the damping solution applicator roller, the intermediate roller and into the inking unit, where the washing solution is able to clean the corresponding rollers.

In order to ensure that no washing liquid penetrates into the ink reservoir of the printing press, the control apparatus separates an ink supply apparatus from the rollers of the inking unit that lead to the plate cylinder. The separation point can be made, for example, between a vibrator and a roller that co-operates with the vibrator. The vibrator may cooperate periodically with an ink duct of the printing press.

It is also possible to wash the rollers of the inking unit by employing the control apparatus to bring the inking rollers into engagement with the plate cylinder. Under such circumstances, the washing liquid is supplied by a shorter route to the inking unit. Such a route is via the inking rollers when the inking rollers contact the plate cylinder. It is then possible for the damping unit to be simultaneously washed with the intermediate roller. Furthermore, it is also possible to bring inking rollers and damping solution applicator rollers into engagement with the plate cylinder for cleaning. With the rollers in relative engagement in this manner, the inking unit and the damping unit can be connected or disconnected by the selective engagement of the intermediate roller.

The present invention relates, further, to a process for cleaning the cylinders and rollers of a printing unit of a printing press, such as an offset printing press, wherein the printing unit includes a plate cylinder, a rubber blanket cylinder, an impression cylinder, an inking unit and a damping unit. The inking unit and the damping unit include, respectively, inking rollers and damping solution applicator rollers. The printing unit also includes washing apparatus that is brought into engagement with the rubber blanket cylinder in order to perform the washing operation. The relative positions of the rubber blanket cylinder and impression cylinder are freely controllable in such a manner that, during the washing operation, they assume an engaged or disengaged position.

German Patent Publication No. 25 31 886 discloses a process for the cleaning of the cylinders of an offset printing unit in which, after the startup of a rubber blanket cylinder washing apparatus, the rubber blanket cylinder is brought into engagement with the impression cylinder, with the result that the impression cylinder is simultaneously cleaned with the rubber blanket cylinder. However, because the control system cannot be manually operated, this known design does not provide, during the washing of the rubber blanket cylinder, for the prevention of the cleaning of the impression cylinder, even though such cleaning is often not necessary at all. Conversely, however, the free controllability of the rubber blanket cylinder and the impression cylinder, according to the present invention, allows the operator of the printing press to either simultaneously wash the rubber blanket cylinder and the impression cylinder, or not wash the impression cylinder at all.

Since the relative positions of the rubber blanket cylinder, the plate cylinder, the damping solution applicator roller, the inking roller(s) and/or the intermediate roller are freely controllable and adjustable, it is possible, depending on the control state, for these cylinders and/or rollers to be cleaned or for such cleaning to be prevented, even though only one washing apparatus is provided.

In particular, it is advantageous if the free controllability of the impression cylinder is effected by means of the paper thickness compensator, even though the actual purpose of the paper thickness compensator is to compensate for the thickness of the stock in the running-on mode. According to the present invention, therefore, the paper thickness compensator is put to a novel use in that it is not employed in the actual printing process, but rather, in the washing process. Because of the adjustability of the paper thickness compensator, which can be effected preferably by remote control by means of a drive, it is possible to achieve both an engaged position of rubber blanket cylinder and impression cylinder and also a disengaged position of those cylinders. Consequently, the impression cylinder is either washed simultaneously with the blanket cylinder, or is not washed at all.

Since, during the washing operation, a metering roller of the damping unit that cooperates with a damping solution fountain roller is disengaged from the damping solution applicator roller, no washing liquid can penetrate into the damping solution supply apparatus of the printing press. The same applies to the inking unit. Therefore, during the washing operation, a vibrator of the inking unit, that cooperates with an ink-duct roller, is disengaged from the inking-unit roller that leads to the inking rollers. This results in the prevention of the penetration of washing liquid into the ink supply apparatus.

One aspect of the invention resides broadly in a method for washing the cylinders and the rollers of an offset printing press, the offset printing press having an inking unit, a damping unit, a washing unit, a blanket cylinder, a plate cylinder, an impression cylinder and a paper thickness compensator, the method comprising the steps of: engaging the washing unit with the blanket cylinder; engaging one of: a) the impression cylinder and, b) the plate cylinder, with the blanket cylinder by means of the paper thickness compensator; transferring washing solution from the washing unit to the blanket cylinder; transferring washing solution from the blanket cylinder to the one of: a) the impression cylinder and, b)

the plate cylinder, being engaged with the blanket cylinder; and washing with the washing solution the blanket cylinder and the one of: a) the impression cylinder, and b) the plate cylinder, being engaged with the blanket cylinder.

BRIEF DESCRIPTION OF THE DRAWINGS

The following Description of the Preferred Embodiments may be better understood when taken in conjunction with the appended drawings in which.

DESCRIPTION OF THE PREFERRED EMBODIMENTS

Figure 1A:
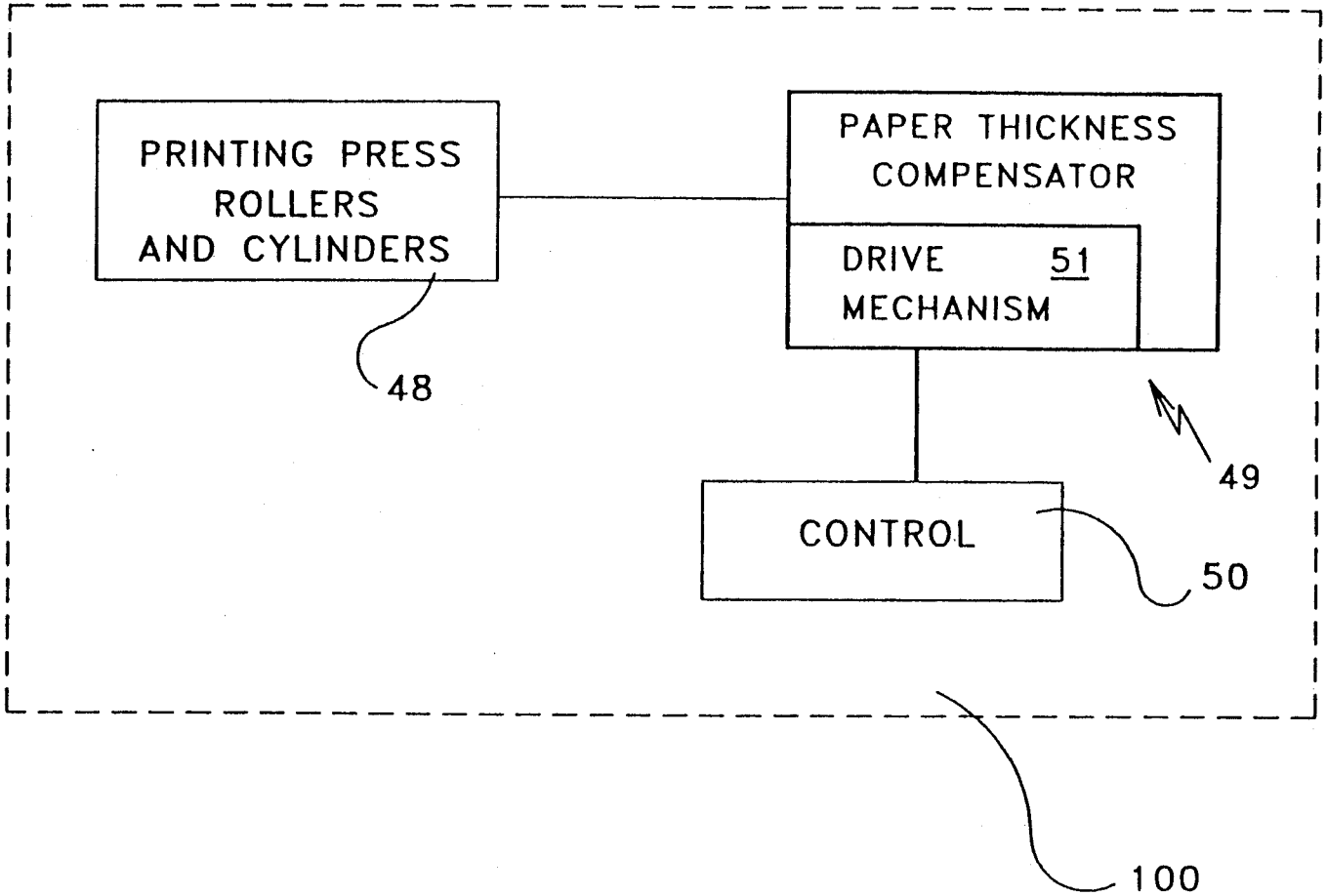
FIG. 1A is a block diagram of various components of an offset printing press in which the present invention is employed.

FIG. 1A is a block diagram of offset printing press 100 showing a schematic relationship between rollers and cylinders 48 of offset printing press 100, paper thickness compensator 49 of printing press 100, and control 50 of offset printing press 100. Paper thickness compensator 49 also includes drive mechanism 51, which may be a remotely controllable drive and/or an electric drive.

Figure 1B:
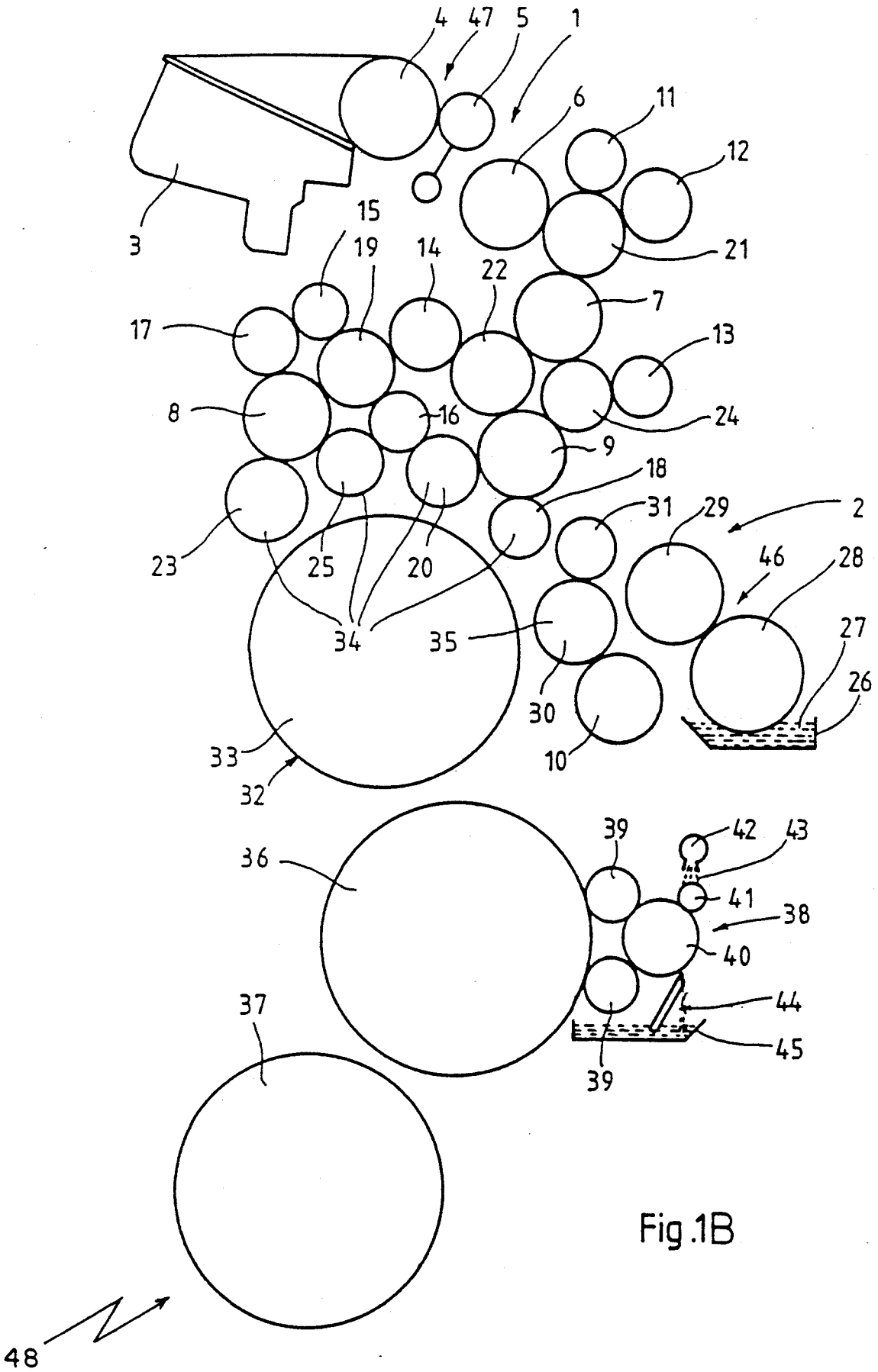
FIG. 1B is a schematic diagram of the rollers of the offset printing press of FIG. 1A, wherein the rollers are in position for washing a rubber blanket cylinder of the printing press.

FIG. 1B is a schematic diagram of the rollers of offset printing press 100. Printing press 100 includes inking unit 1 and damping unit 2. Inking unit 1 includes ink duct 3 that has metering elements (not shown) for setting zonal inking gaps as is well known. Ink duct roller 4 withdraws ink in a metered manner from ink duct 3 during operation. Swivelable vibrator 5 cooperates with ink duct roller 4 as well as with driven distributor 6. Damping unit 2 comprises damping solution box 26 that is filled with damping solution 27. Fountain roller 28 is partially immersed in damping solution 27. Fountain roller 28 cooperates with metering roller 29. Further provided, in offset printing press 100, is rubber covered roller 30.

Inking unit 1 and damping unit 2 include driven distributors 7–10. In addition, there are rider and transfer rollers 11–16 and rubber covered rollers 17–25. It is possible for inking unit 1 and damping unit 2 to be connected to one another through intermediate roller 31. That occurs when intermediate roller 31 is brought into engagement with rollers 30 and 18.

Both ink and damping solution can be supplied to printing form 32 of plate cylinder 33 through the above-described rollers and cylinders. Printing form 32 may be a printing plate clamped onto plate cylinder 33. The transfer of ink and damping solution from inking unit 1 and damping unit 2 to printing form 32 may be effected by rubber covered rollers 18, 20, 23, 25 and 30. Rubber covered rollers 18, 20, 23 and 25 may collectively be referred to as ink transferring inking rollers 34. Rubber covered roller 30, that transfers damping solution 27, may be referred to as damping solution applicator roller 35.

Rubber blanket cylinder 36 and impression cylinder 37 are also provided in offset printing press 100. Washing apparatus 38 cooperates with rubber blanket cylinder 36. Washing apparatus 38 is adapted t be brought into contact with the outer cylindrical surface, i.e. with the rubber blanket (not shown), of rubber blanket cylinder 36 by the operation of control 50. Washing apparatus 38 includes two washing rollers 39 as well as common roller 40 that connects the two washing rollers 39 together. Also provided is transfer roller 41, which is in contact with common roller 40 and to which washing liquid 43 can be supplied by either spray apparatus 42, or another similar device. Doctor blade apparatus 44 cooperates with roller 40. Collection trough 45 is positioned under roller 40 for collecting excess washing liquid 43.

Drive 51 may be remotely controllable by control 50. Control 50 may be located on the control console (not shown) of offset printing press 100 and receive control signals from a computer (not shown) of offset printing press 100. The distance between rubber blanket cylinder 36 and impression cylinder 37 is adjustable by paper thickness compensator 49 and control 50. In the running-on mode, such adjustment is made according to the thickness of the stock used.

With the present invention however, when offset printing press 100 is in the washing mode, paper thickness compensator 49 is used to either engage rubber blanket cylinder 36 and impression cylinder 37 with one another, or to disengage cylinders 36 and 37 from one another. Consequently, paper thickness compensator 49 is freely controllable so that it may be employed for its known function of compensating for variations in stock, or paper thickness, and also for an entirely different and novel operating mode according to the present invention wherein paper thickness compensator 49 functions to move various rollers and/or cylinders into and out of contact with one another during the wash cycle to selectively wash desired rollers and/or cylinders.

As a result, it is possible during the washing mode to switch to the "PRINT START" mode wherein initially, rubber blanket cylinder 36 and plate cylinder 33 come into contact with one another. Subsequently, approximately after one revolution, impression cylinder 37 and rubber blanket cylinder 36 come into contact with one another. If, however, no stock is supplied and, furthermore, paper thickness compensator 49 is adjusted according to the present invention in such a manner that rubber blanket cylinder 36 and impression cylinder 37 are disengaged from one another, then, with washing apparatus 38 in engagement with rubber blanket cylinder 36, both rubber blanket cylinder 36, plate cylinder 33 and printing form 32 may be washed.

Additionally, control 50 permits the free controllability of the individual rollers and cylinders 48 of offset printing press 100. The result of such control is that it is possible to move, either individually or in a variety of combinations, rubber blanket cylinder 36, plate cylinder 33, inking rollers 34, damping solution applicator roller 35, metering roller 29, vibrator 5 and/or intermediate roller 31 into and out of contact with adjacent rollers and/or cylinders. This free controllability of movement also exists with regard to impression cylinder 37, wherein blanket cylinder 36 and impression cylinder 37 are moved into contact with one another either by paper thickness compensator 49 or by any well known apparatus that can move cylinders 36 and/or 37.

Rollers and cylinders 48 of offset printing press 100, as shown in FIGS. 1A–8, permit the following washing modes:

In FIG. 1B, plate cylinder 33 and impression cylinder 37 are disengaged from rubber blanket cylinder 36. The result of such disengagement is that rollers 39 of washing apparatus 38, that are in contact with the outer cylindrical surface of rubber blanket cylinder 36, clean only the rubber blanket (not shown) that may be clamped onto rubber blanket cylinder 36 and/or rubber blanket cylinder 36.

Figure 2:
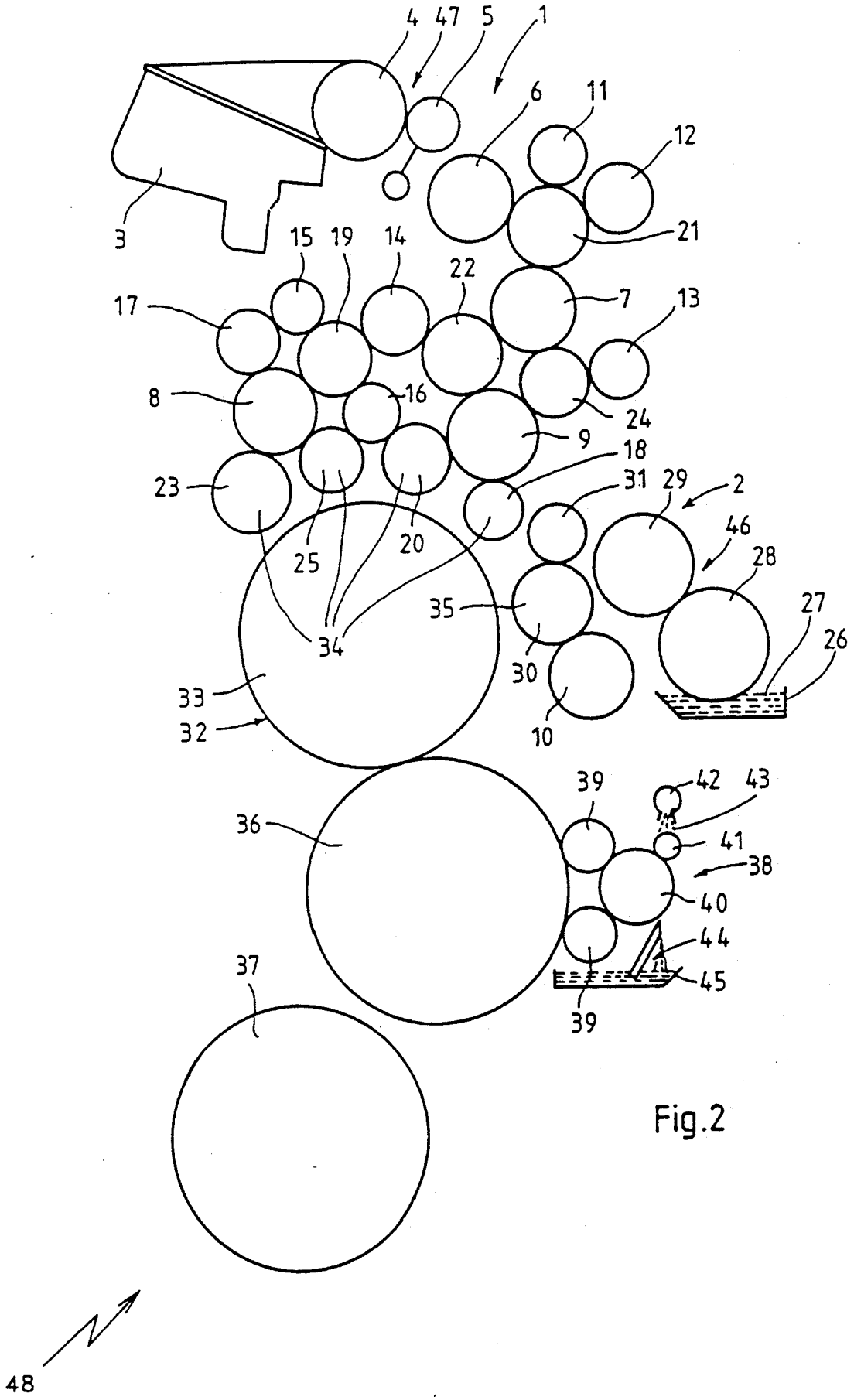
FIG. 2 is a schematic diagram of the rollers of the offset printing press of FIG. 1A, wherein the rollers are in position for washing the rubber blanket cylinder and the plate cylinder of the printing press.

With rollers and cylinder 4B in the positions as shown in FIG. 2, impression cylinder 37 is disengaged from rubber blanket cylinder 36 as a result of a corresponding adjustment of control 50 and paper thickness compensator 49. The outer cylindrical surface of rubber blanket cylinder 36 is contacted by washing rollers 39 of washing apparatus 38. In addition, there is contact between rubber blanket cylinder 36 and plate cylinder 33. With rollers and cylinders 48 in these positions, rubber blanket cylinder 36, printing form 32 and plate cylinder 33 are cleaned simultaneously.

Figure 3:
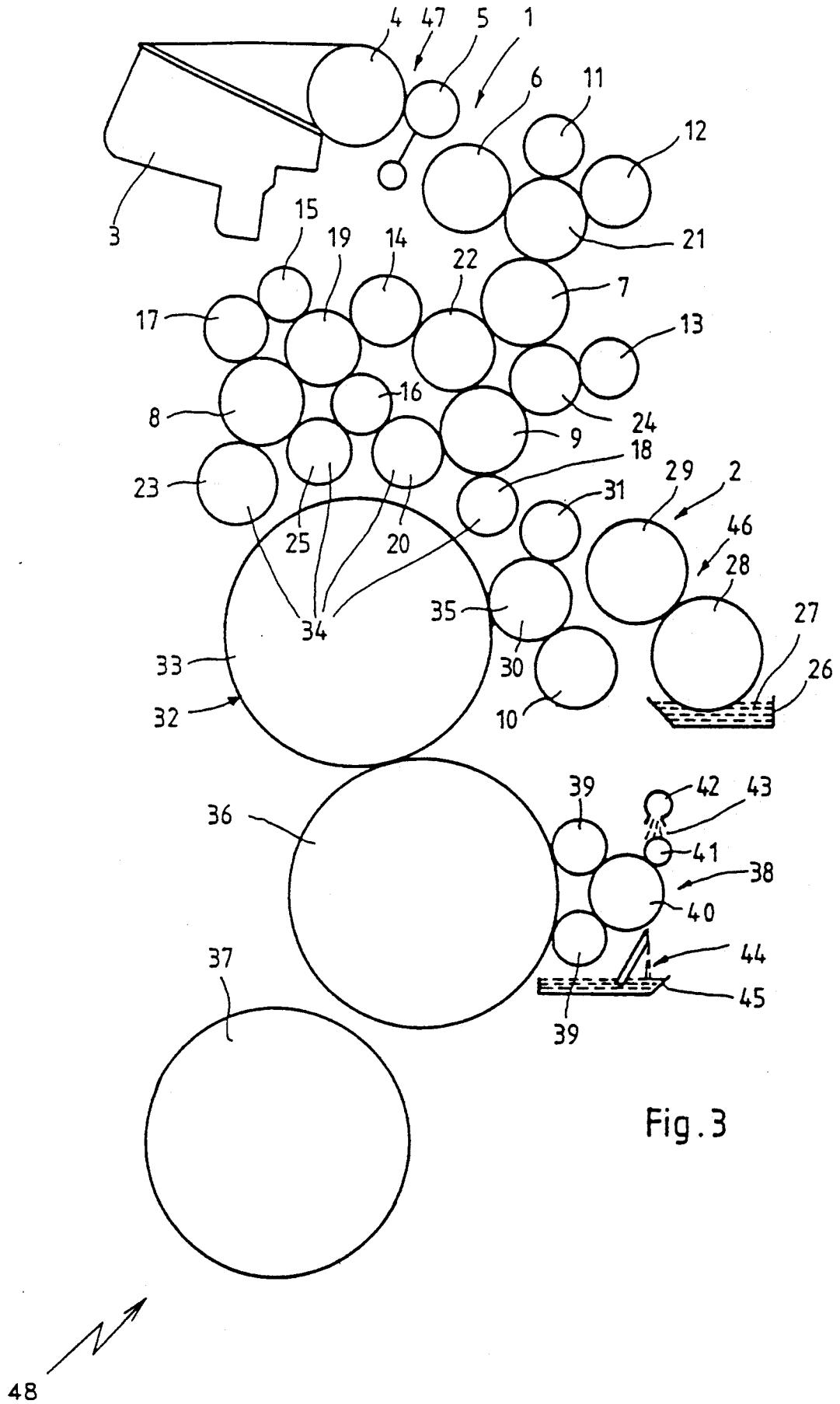
FIG. 3 is a schematic diagram of the rollers of the offset printing press of FIG. 1A, wherein the rollers are in position for washing the rubber blanket cylinder, the plate cylinder and the damping unit rollers of the printing press.

FIG. 3 shows the positions of rollers and cylinders 48 wherein rubber blanket cylinder 36, plate cylinder 33, printing form 32 and rollers 30 and 31 and driven distributor 10 of damping unit 2 are cleaned or washed. With rollers and cylinders 48 in the position shown in FIG. 3, rubber blanket cylinder 36 and plate cylinder 33 are engaged with one another. Furthermore, damping solution applicator roller 35, or rubber covered roller 30, is in contact with printing form 32 of plate cylinder 33. Driven distributor 10 and intermediate roller 31 are in engaged with damping solution applicator roller 35. Ink transferring inking rollers 34 are disengaged from plate cylinder 33. Consequently, the washing liquid supplied from washing apparatus 38 is transferred to rubber blanket cylinder 36, to printing form 32 and plate cylinder 33 and to damping solution applicator roller 35. From roller 35, the washing solution is transferred to intermediate roller 31 and to driven distributor 10. Therefore, all of the aforementioned cylinders and rollers that are in direct or indirect contact with washing apparatus 38 are cleaned or washed. Such washing also occurs to at least some of the components of damping unit 2 that may be soiled with ink particles that migrate during the running-on process from intermediate roller 31 into damping unit 2, or particles that emanate from printing form 32.

In order to prevent washing liquid from entering damping solution supply 46 of damping unit 2, metering roller 29 is moved by paper thickness compensator 49 and control 50 so that it is disengaged from damping solution applicator roller 35. Moreover, such roller positioning also prevents damping solution 27 from being supplied to damping solution applicator roller 35 and from diluting the washing liquid, or solution.

Figure 4:
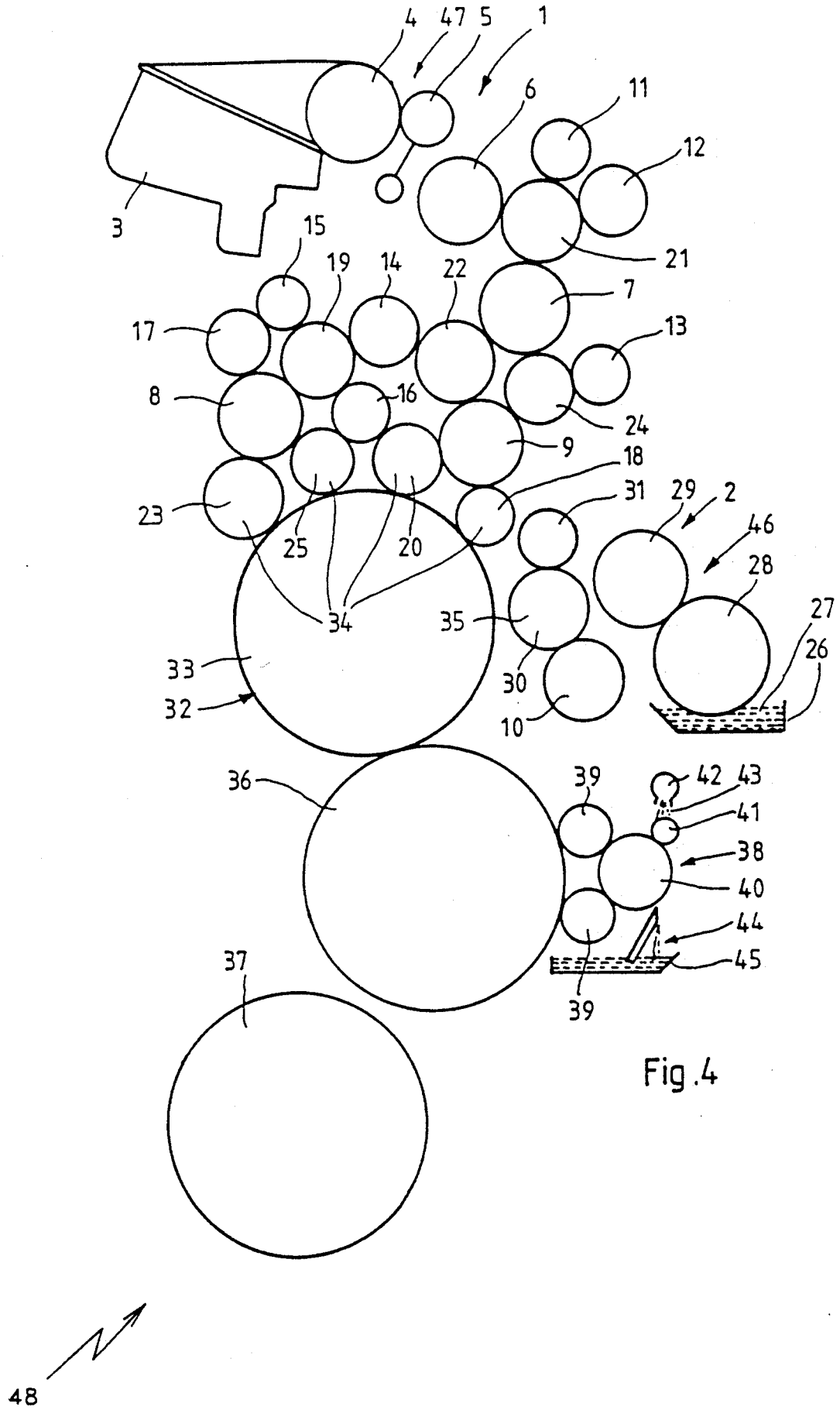
FIG. 4 is a schematic diagram of the rollers of the offset printing press of FIG. 1A, wherein the rollers are in position for washing the rubber blanket cylinder, the plate cylinder and the inking unit rollers of the printing press.

In FIG. 4, rollers and cylinders 48 are positioned such that washing rollers 39 of washing apparatus 38 are in contact with rubber blanket cylinder 36. Rubber blanket cylinder 36 is disengaged from impression cylinder 37 and engaged with printing form 32 and plate cylinder 33. Inking rollers 34 are engaged with plate cylinder 33, damping solution applicator roller 35 is disengaged from plate cylinder 33. Additionally, intermediate roller 31 is engaged with damping solution applicator roller 35 and disengaged from its nearest inking roller 34. Also, damping solution applicator roller 35 is disengaged from its nearest inking roller 34 (so-called small separation). Consequently, the washing liquid passes from rubber blanket cylinder 36 to printing form 32 and plate cylinder 33, to inking rollers 34 and to the corresponding rollers and cylinders of inking unit 1, thereby resulting in all of those parts being cleaned or washed. In order to prevent washing liquid 43 from entering ink-supply apparatus 47 of inking unit 1, vibrator 5 is controlled by paper thickness compensator 49 and control 50 to be disengaged from distributor 6. Impression cylinder 37 is disengaged from rubber blanket cylinder 36, by paper thickness compensator 49 and control 50, such that impression cylinder 37 is not cleaned. In contrast to the known, otherwise customary processes for cleaning plate cylinder 33, through the intermediary of inking unit 1, an entirely different approach is adopted with the present invention in that inking unit 1 is cleaned by washing solution 43 that is supplied from rubber blanket cylinder 36 and plate cylinder 33.

Figure 5:
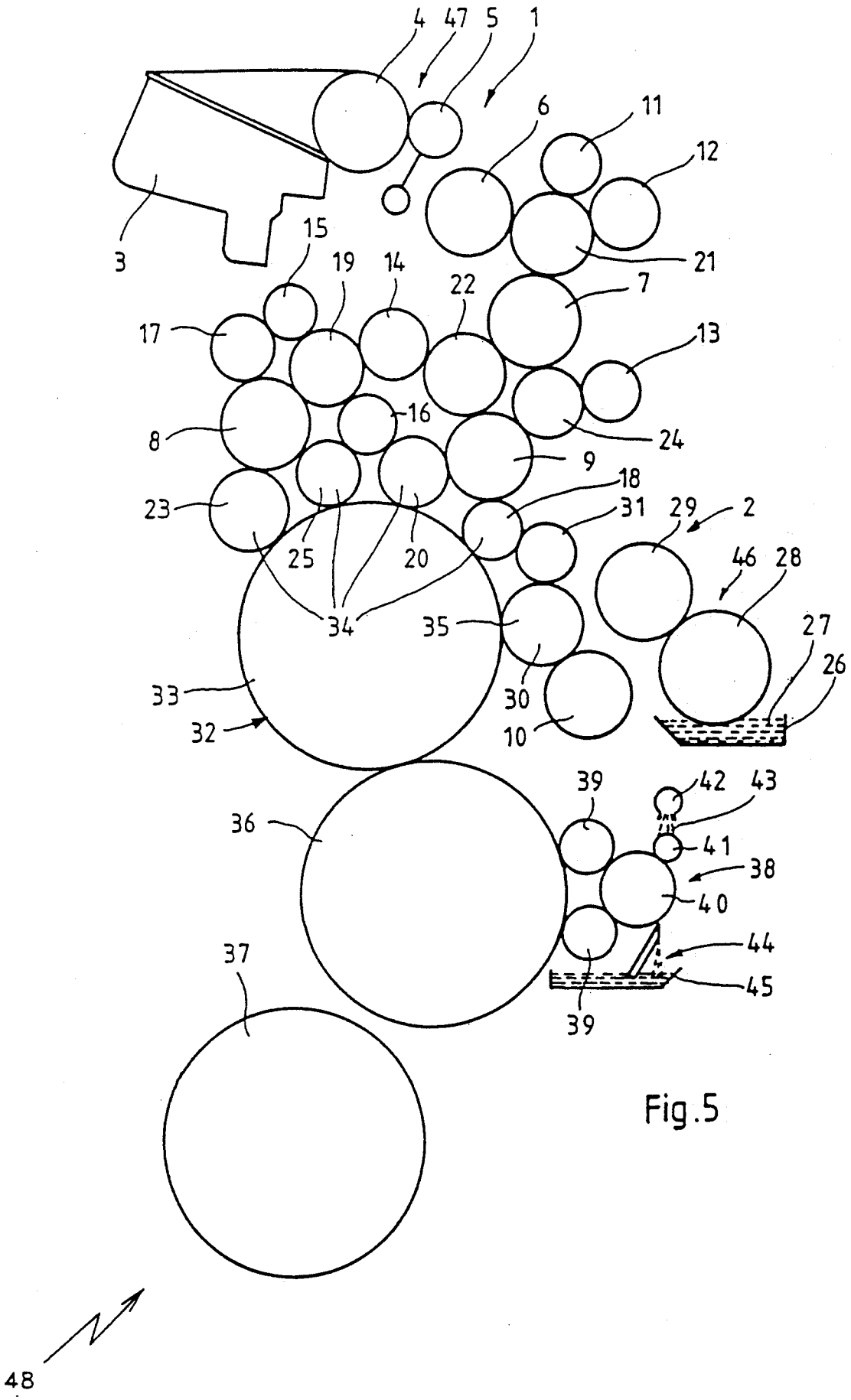
FIG. 5 is a schematic diagram of the rollers of the offset printing press of FIG. 1A, wherein the rollers are in position for washing the rubber blanket cylinder, the plate cylinder, the damping unit rollers and the inking unit rollers of the printing press.

FIG. 5 shows the positions of rollers and cylinders 48 during the running-on process. However, even during such running-on process, rollers 39 of washing apparatus 38, are in contact with the outer cylindrical surface of rubber blanket cylinder 36. Furthermore, impression cylinder 37 and rubber blanket cylinder 36 are disengaged from one another, by means of paper thickness compensator 49 and control 50. Additionally, metering roller 29 and damping solution applicator roller 35 are disengaged from one another. Also, distributor 6 and vibrator 5 are disengaged from one another. Rubber blanket cylinder 36 and plate cylinder 33 are engaged with one another. Rollers 34 and damping solution applicator roller 35 are engaged with plate cylinder 33. Inking unit 1 and damping unit 2 are connected to one another by intermediate roller 31. The above described relative positions of rollers and cylinders 48 permit comprehensive cleaning of inking unit 1 and damping unit 2 as well as plate cylinder 33 and rubber blanket cylinder 36 since washing liquid 43 can reach those members through the above described direct and/or indirect contact with washing apparatus 38. If cleaning of impression cylinder 37 is also desired, paper thickness compensator 49 can be adjusted by control 50 such that impression cylinder 37 contacts rubber blanket cylinder 36. Such contact, in turn, causes the washing liquid to wet the outer cylindrical surface of impression cylinder 37.

Figure 6:
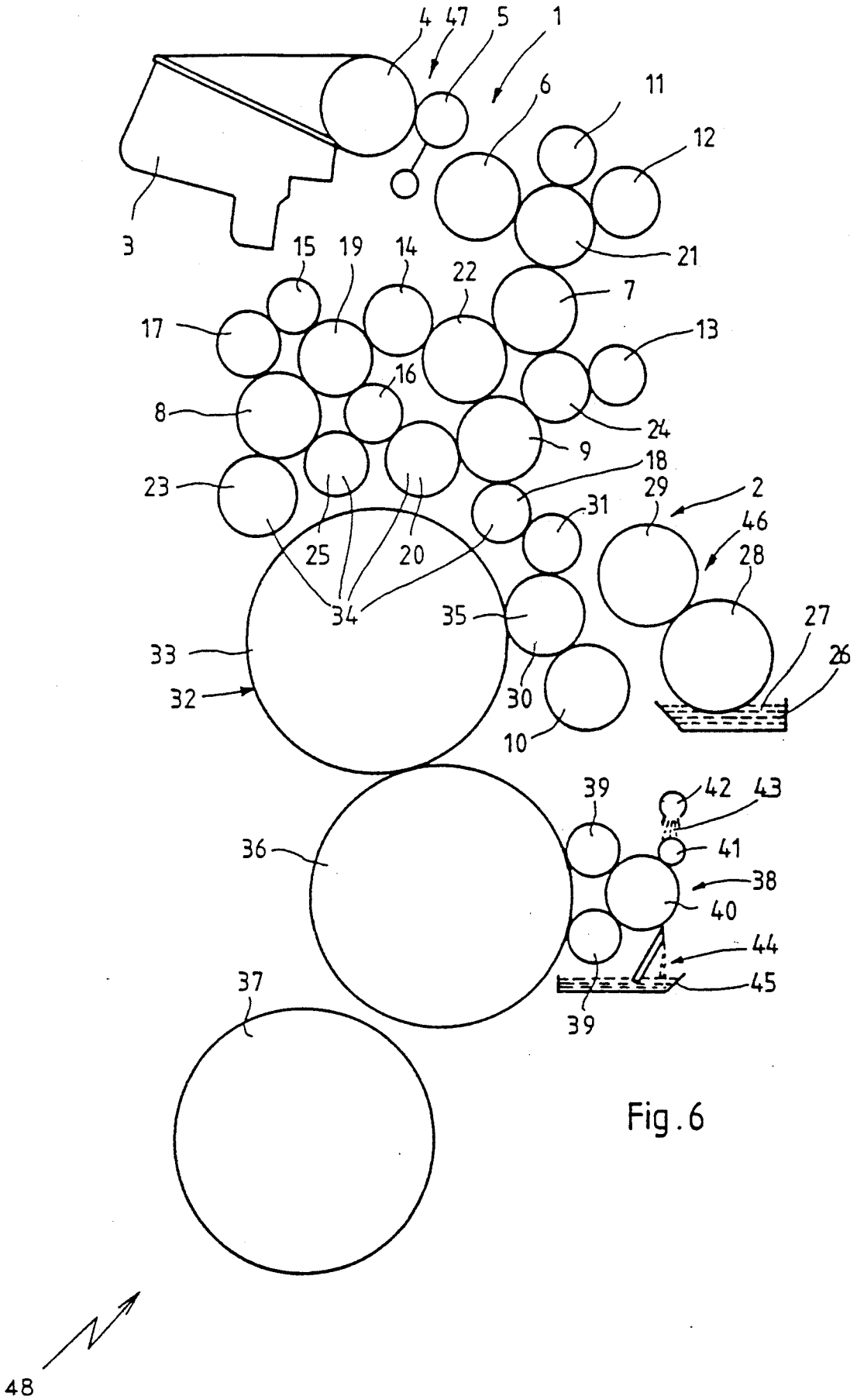
FIG. 6 is a schematic diagram of the rollers of the offset printing press of FIG. 1A, wherein the rollers are in position for washing the rubber blanket cylinder, the plate cylinder, the damping unit rollers and the inking unit rollers of the printing press, wherein the damping unit supply washing solution to an intermediate roller and the intermediate roller supplies washing solution to the inking unit rollers.

FIG. 6 shows the relative positions of rollers and cylinders 48 in which inking unit 1 and damping unit 2 are connected to one another through intermediate roller 31. Also, damping solution applicator roller 35 is engaged with plate cylinder 33. Furthermore, rubber blanket cylinder 36 and plate cylinder 33 are in contact with one another. Rollers 39 of washing apparatus 38 are in contact with rubber blanket cylinder 36. Damping solution supply apparatus 46 is separated from intermediate roller 31 and damping solution applicator roller 35. Ink supply apparatus 47 is separated from the other components of inking unit 1. However, portions of damping unit 2 and portions of inking unit 1 are cleaned by washing solution received through intermediate roller 31. In this case washing liquid is transferred from plate cylinder 33 to roller 30 and distributor 10. Roller 30, in turn, transfers washing liquid to intermediate roller 31 and intermediate roller 31 transfers washing liquid to inking unit 1.

Figure 7:
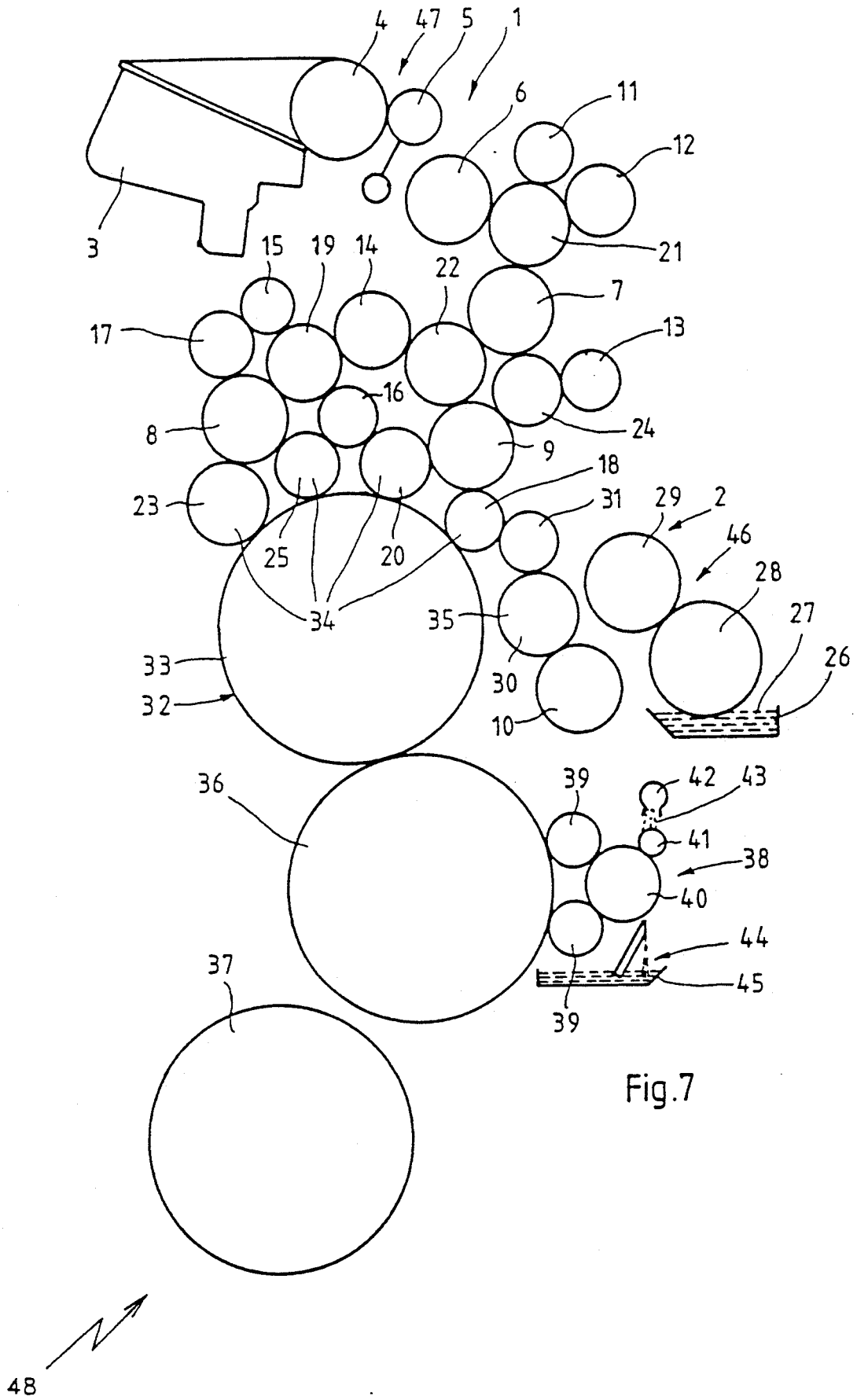
FIG. 7 is a schematic diagram of the rollers of the offset printing press of FIG. 1A, wherein the rollers are in position for washing the rubber blanket cylinder, the plate cylinder, the inking unit rollers and the damping unit rollers of the printing press, wherein the inking unit rollers supplies washing solution to an intermediate roller and the intermediate roller supplies washing solution to the damping unit rollers.

FIG. 7 shows rollers and cylinders 48 in relative positions wherein portions of damping unit 2 are cleaned through inking unit 1. In this case, rubber blanket cylinder 36 and plate cylinder 33 are engaged with one another. Furthermore, inking rollers 34 are in engagement with printing form 32 of plate cylinder 33. One of inking rollers 34 is connected to damping solution applicator roller 35 through intermediate roller 31. However, intermediate roller 31 is not in contact with plate cylinder 33. Damping solution supply apparatus 46 and ink supply apparatus 47 are, as a result of their relative positions, separated from metering roller 29 and vibrator 5, respectively. Washing liquid 43 passes from washing apparatus 38 to rubber blanket cylinder 36 and then to printing form 32 and plate cylinder 33. Plate cylinder 33 transfers some of washing liquid 43 to inking unit 1 by inking rollers 34. From inking unit 1, washing liquid 43 passes to intermediate roller 31 and from intermediate roller 31 to damping solution applicator roller 35 and then to the driven distributor 10. Again, as with all the other relative positions of rollers and cylinders 48 shown in FIGS. 1B-6, it is possible for impression cylinder 37 to be disengaged by means of paper thickness compensator 49 and control 50, from rubber blanket cylinder 36. Also, it is possible for impression cylinder 37 to be engaged, by paper thickness compensator 49 and control 50, with rubber blanket cylinder 36 thereby allowing impression cylinder 37 to be cleaned.

Figure 8:
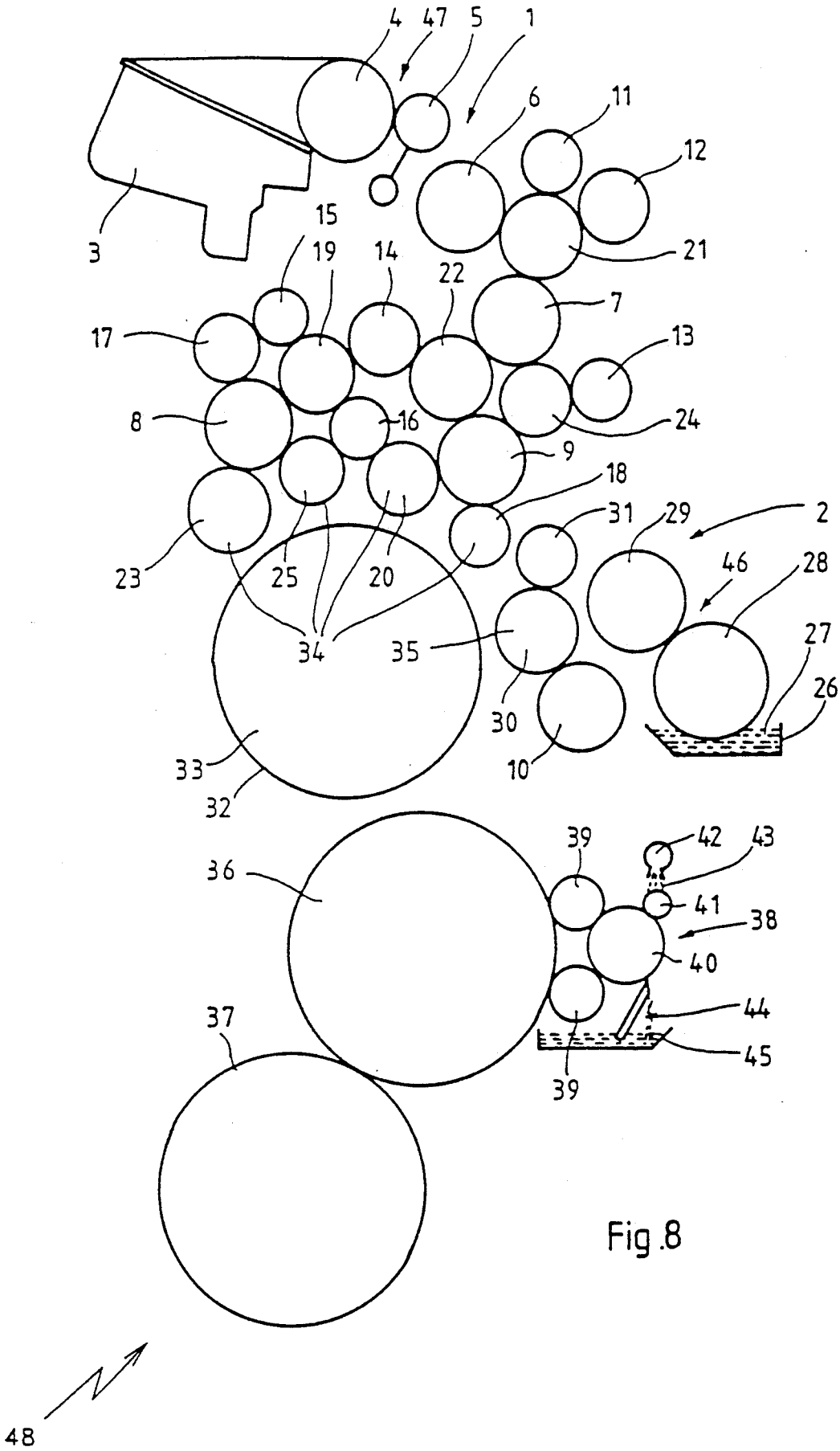
FIG. 8 is a schematic diagram of the rollers of the offset printing press of FIG. 1A, wherein the rollers are in position for washing the blanket cylinder and the impression cylinder of the printing press.

FIG. 8 shows the relative positions of rollers and cylinders 48 in which rubber blanket cylinder 36 is engaged with impression cylinder 37. That results in the cleaning of those two cylinders with washing apparatus 38. The engaged position is achieved by suitable adjustment of control 50 and paper thickness compensator 49.

In summary, one feature of the invention resides broadly in a printing press, in particular offset printing press, the printing unit of which comprises a plate cylinder, a rubber blanket cylinder and an impression cylinder as well as an inking unit and a damping unit, said inking unit and damping unit being provided, respectively, with inking rollers and damping solution applicator rollers, and with a washing apparatus, said washing apparatus, when in wash-mode position being brought into engagement with the rubber blanket cylinder by a control apparatus, characterized in that, in wash mode, the impression cylinder 37 is moved into the engaged or disengaged position with respect to the rubber blanket cylinder 36 by a paper thickness compensator, the actual purpose of said paper thickness compensator being to compensate for the thickness of the stock in running-on mode.

Another feature of the invention resides broadly in a printing press characterized in that the paper thickness compensator comprises a remotely controllable drive, in particular an electric drive.

Still another feature of the invention resides broadly in a printing press according characterized in that the control apparatus moves the rubber blanket cylinder 36 into an engaged position with respect to the plate cylinder 33.

Yet another feature of the invention resides broadly in a printing press characterized in that the control apparatus moves the damping solution applicator roller 35 into an engaged position with respect to the plate cylinder 33.

Another feature of the invention resides broadly in a printing press characterized in that the control apparatus separates a damping solution supply apparatus 46 from rollers of the damping unit 2, said rollers leading to the plate cylinder 33.

Still another feature of the invention resides broadly in printing press characterized in that the control apparatus connects the inking unit 1 and the damping unit 2 to one another through the intermediary of an intermediate roller 31, with the result that rollers of the inking unit 1 and/or of the damping unit 2 are washed with washing liquid supplied from the damping unit 2 and/or inking unit 1.

A further feature of the invention resides broadly in a printing press characterized in that, in order to wash the rollers of the inking unit 1, the control apparatus brings the inking rollers 34 into engagement with the plate cylinder 33.

Still another feature of the invention resides broadly in a printing press characterized in that the control apparatus separates an ink-supply apparatus 47 from rollers of the inking unit 1, said rollers leading to the plate cylinder 33.

Yet another feature of the invention resides broadly in a process for the cleaning of cylinders and rollers of a printing unit of a printing press, in particular offset printing press, in which the printing unit comprises a plate cylinder, a rubber blanket cylinder and an impression cylinder as well as an inking unit and a damping unit, said inking unit and damping unit being provided, respectively, with inking rollers and damping solution applicator rollers, said printing unit being further provided with a washing apparatus, said washing apparatus being brought into engagement with the rubber blanket cylinder in order to perform the washing operation, characterized in that the relative positions of rubber blanket cylinder 36 and impression cylinder 37 are freely controllably adjustable in such a manner that, for the washing operation, they assume an engaged or disengaged position.

Still another feature of the invention resides broadly in a process characterized in that the relative positions of rubber blanket cylinder 36 and plate cylinder 33 and/or plate cylinder 33 and damping solution applicator roller 35 and/or plate cylinder 33 and inking roller(s) 34 and/or if an intermediate roller 31 and of the damping solution applicator roller 35 or inking roller 34 are freely controllably adjustable.

A yet further feature of the invention resides broadly in a process characterized in that the free controllability of the impression cylinder 37 is effected by means of a paper thickness compensator, the actual purpose of said paper thickness compensator being to compensate for the thickness of the stock in running-on mode.

A further feature of the invention resides broadly in a process characterized in that, for the washing operation, a metering roller 29 of the damping unit 2—said metering roller 29 cooperating with a damping solution fountain roller 28 is disengaged from the damping solution applicator roller 35.

Yet another feature of the invention resides broadly in a process characterized in that, for the washing operation, a vibrator 5 of the inking unit 1—said vibrator 5 cooperating with an ink-duct roller 4—is disengaged from an inking-unit roller (distributor 6), said inking-unit roller leading to the inking rollers 34.

Still another feature of the invention resides broadly in the application of a paper thickness compensator said paper thickness compensator acting between a rubber blanket cylinder 36 and an impression cylinder 37 of a printing unit of a printing press—for an engaged or disengaged position of the cylinders during a washing operation, said washing operation being performed with a rubber blanket cylinder washing apparatus 38.

Patents relating to paper thickness compensators include U.S. Pat. No. 4,690,052, entitled "Means for Compensating for Variations in the Matrix Height and Optionally the Paper Thickness on a Rotary Printing Machine," U.S. Pat. No. 4,440,516, entitled "Transport Device for Transporting an Endless Form To and From the Printing Roller", and U.S. Pat. No. 4,094,243, entitled "Device for Adjusting Form Rollers Providing Automatic Compensation for Change in Packing Thickness."

Patents relating to Offset Printing Machines include U.S. Pat. No. 4,723,488, entitled "Apparatus For Intermittently Feeding Continuous Paper in a Printing Press," U.S. Pat. No. 4,815,377 entitled "Engaging and Disengaging Device for Blanket Cylinders of a Four-cylinder Printing Assembly for Roller Rotary Offset Printing Machines," U.S. Pat. No. 4,691,631, entitled "Cylinder Setting Mechanism for an Offset Printing Machine," and U.S. Pat. No. 4,676,158, entitled "Plate Pressure and Printing Pressure Adjusting Mechanism for Offset Printing Machine."

Patents relating to Washing Machines for Printing Presses include U.S. Pat. No. 4,781,116, entitled "Washing Method And Apparatus For Guide Rollers Of Rotary Press," U.S. Pat. No. 4,722,273, entitled "Washing Device For Washing A Rubber Blanket In A Rotary Offset Printing Press," U.S. Pat. No. 4,555,989, entitled "Apparatus For Washing A Rubber Blanket Cylinder Of A Printing Machine," U.S. Pat. No. 4,632,030, entitled "Printing Press Washer," U.S. Pat. No. 4,534,291, entitled "Method And Apparatus For Cleaning Printing Presses," U.S. Pat. No. 4,270,450, entitled "Arrangement For Washing Cylinders On Printing Presses," U.S. Pat. No. 3,976,007, entitled "Washing Device Adjustable With Respect To The Blanket Cylinder," and U.S. Pat. No. 4,841,862, entitled "Device For Washing The Outer Surface Of A Blanket Cylinder Of An Offset Printing Machine."

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A method for washing the cylinders and the rollers of an offset printing press, the offset printing press having an inking unit, a damping unit, a washing unit for supplying a washing solution, a blanket cylinder, a plate cylinder, an impression cylinder a paper thickness compensator, and a washing control circuit for controlling the flow of the washing solution through the printing press said method comprising the steps of:

actuating the washing control circuit to engage the washing unit with the blank cylinder;

selectively engaging or disengaging the impression cylinder with the blanket cylinder by means of the paper thickness compensator;

transferring washing solution from the washing unit to the blanket cylinder;

transferring washing solution from the blanket cylinder to the impression cylinder, whenever the impression cylinder is selectively engaged with the blanket cylinder by means of the paper thickness compensator; and washing with the washing solution the blanket cylinder and the impression cylinder, whenever the impression cylinder is selectively engaged with the blanket cylinder by means of the paper thickness compensator.

2. The method of claim 1, wherein:

the inking unit includes at least an ink duct, an ink duct roller, at least one ink distributor roller and a vibrator roller;

the damping unit includes at least a damping solution box, a fountain roller and a metering roller;

the washing unit includes at least a washing solution spray apparatus and a plurality of washing rollers;

wherein at least one of: a) a cylinder, and b) a roller, of the offset printing press are washed after performing a first printing job in the offset printing press and prior to performing a second printing job in the offset printing press;

wherein the printing of a printing job in the offset printing press comprises the steps of:

transferring ink from the inking unit to at least one of the cylinders of the offset printing press;

transferring damping solution from the damping unit to at least one of the cylinders of the offset printing press;

supplying stock to be printed to the offset printing press; and printing the stock by the offset printing press; and wherein said method for washing the cylinders and the rollers of the offset printing press further comprises the steps of:

printing a first printing job in the offset printing press;

terminating the printing of the first printing job in the offset printing press;

washing at least one of: a) a cylinder and, b) a roller of the offset printing press; and printing a second printing job in the offset printing press.

3. The method of claim 2, further including the step of:

engaging the plate cylinder with the blanket cylinder by means of the washing control circuit;

transferring washing solution from the blanket cylinder to the plate cylinder; and washing the plate cylinder with the washing solution.

4. The method of claim 3, further including the steps of:

engaging a roller of the damping unit with the plate cylinder by means of the washing control circuit;

transferring washing solution from the plate cylinder to the damping unit roller; and washing the damping unit roller with the washing solution.

5. The method of claim 4, further including the steps of:

providing the offset printing press with an intermediate roller;

engaging the intermediate roller with the damping unit roller by means of the washing control circuit; and transferring washing solution from the damping unit roller to the intermediate roller.

6. The method of claim 5, further including the steps of:

engaging a roller of the inking unit with the intermediate roller by means of the washing control circuit;

transferring washing solution from the intermediate roller to the inking unit roller; and washing the inking unit roller with the washing solution.

7. The method of claim 6, further including the steps of;

independently controlling the relative positions of the blanket cylinder and the impression cylinder such that they selectively assume an engaged or disengaged position during the washing operation, said step of independently controlling the relative positions of the blanket cylinder and the impression cylinder being performed by adjustment of the paper thickness compensator, wherein one actual function of the paper thickness compensator is to compensate for the thickness of the stock in the running-on mode;

independently controlling the relative positions of the blanket cylinder and the plate cylinder such that they selectively assume an engaged or disengaged position during the washing operation;

independently controlling the relative positions of the plate cylinder and a damping solution applicator roller such that they selectively assume an engaged or disengaged position during the washing operation;

independently controlling the relative positions of the plate cylinder and the inking roller such that they selectively assume an engaged or disengaged position during the washing operation;

independently controlling the relative positions of the intermediate roller and a damping solution applicator roller such that they selectively assume an engaged or disengaged position during the washing operation; and independently controlling the relative positions of the intermediate roller and the inking rollers such that they selectively assume an engaged or disengaged position during the washing operation.

8. The method according to claim 7, said method additionally comprising the further step of, during a washing operation of the printing press, disengaging the metering roller of the damping unit from the fountain roller of the damping unit, whereby the supply of damping solution for the printing press is effectively isolated from the washing solution.

9. The method according to claim 8, said method additionally comprising the further step of, during a washing operation of the printing press, disengaging the vibrator roller of the inking unit from the distributor roller of the inking unit, whereby the supply of ink for the printing press is effectively isolated from the washing solution.

10. The method according to claim 9, said method additionally comprising the further step of providing a drive mechanism for operating the paper thickness compensator.

11. The method according to claim 10, wherein said step of providing a drive mechanism comprises the step of providing an electric drive.

12. The method according to claim 11, said method further including the additional step of providing a remote control for controlling the electric drive.

13. The method of claim 3, further including the steps of:

engaging a roller of the damping unit with the plate cylinder by means of the washing control circuit;

engaging a roller of the inking unit with the plate cylinder by means of the washing control circuit;

transferring washing solution from the plate cylinder to the damping unit roller and the inking unit roller; and washing the damping unit roller and the inking unit roller with the washing solution.

14. The method of claim 3, further including the steps of:

engaging a roller of the inking unit with the plate cylinder by means of the washing control circuit;

transferring washing solution from the plate cylinder to the inking unit roller; and washing the inking unit roller with the washing solution.

15. The method of claim 14, further including the steps of:

providing the offset printing press with an intermediate roller;

engaging the intermediate roller with the inking unit roller by means of the washing control circuit; and transferring washing solution from the inking unit roller to the intermediate roller.

16. The method of claim 2, said method further comprising the additional step of providing a drive mechanism for operating the paper thickness compensator.

17. The method of claim 16, wherein said step of providing a drive mechanism comprises the step of providing an electric drive.

18. The method of claim 17, further including the step of providing a remote control for controlling the electric drive.

19. The method of claim 2, further including the step of:

isolating the damping solution box from the plate cylinder when washing solution is being transferring to the damping unit roller.

20. The method of claim 19, further including the steps of:

providing the inking unit with an ink reservoir; and isolating the ink reservoir from the plate cylinder when washing solution is being transferred to the inking unit roller.

* * * * *